US005952930A

United States Patent [19]

Umeda et al.

[11] Patent Number: 5,952,930

[45] Date of Patent: Sep. 14, 1999

[54] IONIC FLAME DETECTOR USING PLURAL ELECTRODES

[75] Inventors: Takahiro Umeda, Yamatokoriyama; Takeshi Nagai, Kitakatsuragi-gun; Toshiro Ogino, Sakurai; Akio Fukuda, Takaichi-gun; Kunihiro Tsuruda, Kashihara, all of Japan

[73] Assignee: Matsushita Electric Industrial Co., Ltd., Osaka, Japan

[21] Appl. No.: 08/959,671

[22] Filed: Oct. 29, 1997

[30] Foreign Application Priority Data

Feb. 13, 1997 [JP] Japan ..... 9-028621
Apr. 18, 1997 [JP] Japan ..... 9-101421

[51] Int. Cl.[6] ..... G08B 17/12

[52] U.S. Cl. ..... 340/579; 431/75; 431/76

[58] Field of Search ..... 340/579; 431/75, 431/76

[56] References Cited

U.S. PATENT DOCUMENTS 4,245,977 1/1981 Morese ..... 431/6
4,710,125 12/1987 Nakamura et al. ..... 431/22

FOREIGN PATENT DOCUMENTS 6-101834 4/1994 Japan .
6-213432 8/1994 Japan .

*Primary Examiner*—Glen Swann
*Attorney, Agent, or Firm*—Ratner & Prestia

[57] ABSTRACT

A pair of reference electrodes and a flame rod are placed in contact with charged particles in a flame produced by a burner. When a voltage is applied between the flame rod and the burner by a power source, a current ($I_{fr}$) flows between them due to the flame conductivity. A potential difference ($V_{12}$) between the pair of reference electrodes is detected by a potential difference detector. The dynamic flame impedance between the pair of reference electrodes is defined as the slope of the $I_{fr}$-$V_{12}$ relationship and is independent of $I_{fr}$.

34 Claims, 13 Drawing Sheets

O: initially measured characteristic in normal combustion at various $V_{fr}$

×: measured characteristic during combustion containing silicone oil at $V_{fr}$=24V solid line: linearly fitted line of the initially measured characteristic

IONIC FLAME DETECTOR USING PLURAL ELECTRODES

FIELD OF THE INVENTION

This invention relates to an apparatus for flame detection using a dynamic flame impedance, which corresponds to flame accurately even if an insulating silicon oxide is formed on both a flame rod and a burner.

BACKGROUND OF THE INVENTION

There have been conventionally used a flame rod as a typical flame detecting means using a flame conductivity in a combustion. The flame rod is placed in contact with flame produced on a burner. When a voltage is applied between the flame rod and the burner, a current flows between them owing to the presence of charged particles (ions and electrons) in the flame. The current is dependent on the conditions of combustion such as input rate and air-fuel ratio. The typical abnormal combustion caused by oxygen deficiency, abnormal air-fuel ratio and other factors reduces the current. Examples of such abnormal combustion detection using the flame rod may be found in U.S. Pat. Nos. 4,245,977 and 4,710,125.

This flame detection has a disadvantage described below. When combustion air contains a small amount of organic silicone compounds which is volatilized from a hair spray for example, an insulating silicon oxide is formed on surfaces of both the flame rod and the burner. As a result, the current is reduced due to its insulating property in spite of no ill effects of the silicone compounds on combustion. On the other hand, the abnormal combustion also reduces the current, as described above. These facts indicate that the conventional flame detection using a current is not able to distinguish whether the decrease in the current is due to the formation of the silicon oxide or is due to abnormal combustion. Therefore, when the current is reduced to some extent, combustion must be forcibly stopped to keep safety combustion even if combustion containing a small amount of silicone compounds is normal.

The conventional apparatuses for flame detection which are able to detect flame even under the conditions of combustion containing a small amount of organic silicone compounds are disclosed in the Japanese Pat. Laid-Open Nos. 6-101834 and 6-213432.

JP 6-101834 discloses a combustion apparatus comprising a flame rod where a portion of the surface of the flame rod in contact with the flame is grooved. This patent describes that the insulating silicon oxide is not formed on the groove because silicone compounds cannot reach the groove. Therefore, the current can flow through the groove.

JP 6-213432 discloses another combustion apparatus comprising a flame rod having a supplementary rod fixed at the portion contacting the flame. The supplementary rod is inferior in thermal stability with respect to the flame rod. This patent describes that the supplementary rod has a cracked surface due to its inferior thermal stability and that the freshly cracked surface on which the silicon oxide is not formed can be used again. Therefore, the current can flow through the cracked surface.

The conventional flame rods described above are effective only when the insulating silicon oxide is formed on the surface of the flame rod. However, since the silicon oxide is also formed on the surface of the burner, the conventional flame rods are ineffective when the insulating silicon oxide is formed on the surface of the burner.

SUMMARY OF THE INVENTION

In accordance with an exemplary embodiment of the present invention, a pair of reference electrodes and a flame rod are placed in contact with charged particles in a flame produced by a burner. When a voltage $V_{fr}$ is applied between the flame rod and the burner by a power source, a current $I_{fr}$ flows between them due to the conductivity of the flame. A potential difference $V_{12}$ between a pair of reference electrodes is detected by a potential difference detecting means. It has been newly found that $V_{12}$ changes linearly with $I_{fr}$. From this finding, a dynamic flame impedance is defined as a slope in the $I_{fr}$-$V_{12}$ characteristic. It is apparent that the dynamic flame impedance is independent of $I_{fr}$.

A feature of an exemplary embodiment of the invention is to use the dynamic flame impedance between a pair of reference electrodes for flame detection. When combustion air contains a small amount of volatile silicone compounds, an insulating silicon oxide is formed on both surfaces of the flame rod and the burner during combustion. As a result, $I_{fr}$ is reduced due to this insulating property despite the fact that the silicone compounds have no ill effects on combustion. However, since the dynamic flame impedance is independent of $I_{fr}$ it does not change even if $I_{fr}$ is reduced largely due to the formation of the insulating silicon oxide.

Another feature of an exemplary embodiment of the present invention is that the dynamic flame impedance is stable as $V_{fr}$ or $I_{fr}$ between the flame rod and the burner varies. The current $I_{fr}$ does not change linearly with $V_{fr}$. However, since the dynamic flame impedance is independent of $I_{fr}$ it is also stable to the variations of $V_{fr}$.

Another feature of an exemplary embodiment of the present invention is that the input rate dependence of the dynamic flame impedance is lower than that of $I_{fr}$. The current $I_{fr}$ is dependent on the mean flame impedance (defined as $R_{fr}=V_{fr}/I_{fr}$) between the flame rod and the burner. Since a large inside flame is produced over all between the flame rod and the burner at a high input rate, the mean flame impedance is low. However, since a small inside flame is produced only near the surface of the burner at a low input rate, the low flame impedance area is limited near the surface of the burner and a large outside flame having a high flame impedance is produced at the outside of the inside flame. The mean flame impedance is mainly determined by the high flame impedance and $I_{fr}$ is reduced inversely proportional to the high mean flame impedance. Therefore, the input rate dependence of $I_{fr}$ is high. On the other hand, since the dynamic flame impedance is the impedance near the surface of the burner, it corresponds to the flame impedance of the inside flame independent from the input rate. As a result, its input rate dependence is low. This characteristic makes it possible to detect the flame over a wide range of input rates.

Various further and more specific objects, features and advantages of the invention will appear from the description given below, taken in connection with accompanying drawings illustrating by way of example of a preferred embodiment of this invention.

BRIEF DESCRIPTION OF THE DRAWING

The invention may be understood by reference to the following description of the preferred embodiment in conjunction with the drawings wherein.

DETAILED DESCRIPTION

Now, an apparatus for flame detection according to an exemplary embodiment of the present invention will be described hereinafter with reference to the accompanying drawings.

Figure 1:
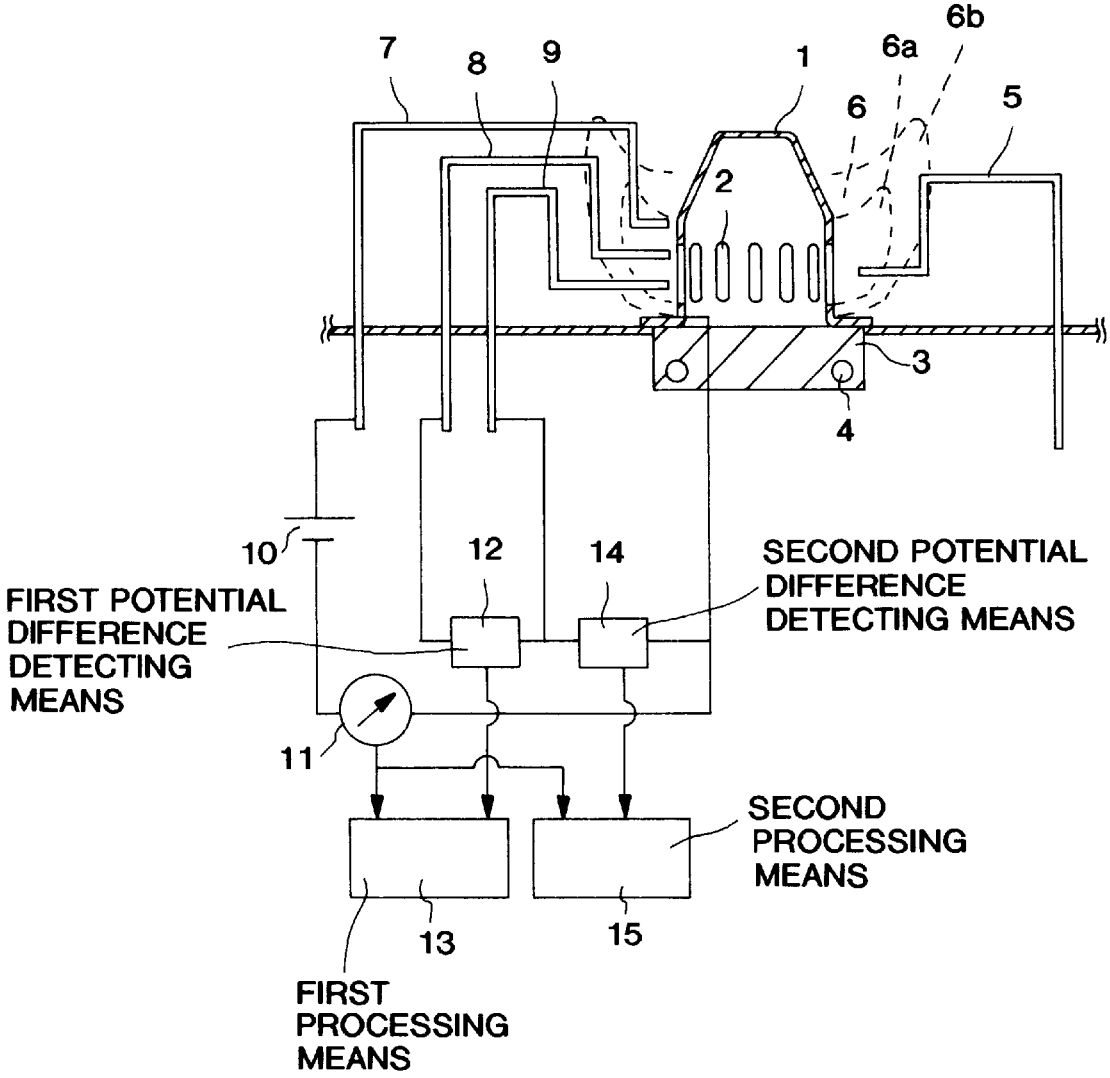
FIG. 1 is a cross-sectional view of an apparatus for flame detection according to a first exemplary embodiment of this invention.

Referring initially to FIG. 1, a conductive burner 1 having many burner ports 2 is fixed on an evaporator 3. Liquid fuel such as kerosene is supplied to the evaporator 3 and it is evaporated by an electrical heater 4 embedded in the evaporator 3. After the evaporated fuel gas is pre-mixed with combustion air, the pre-mixed gas is ignited by ignitor 5. Then a flame 6 is produced on the burner 1. A flame rod 7 and a pair of reference electrodes comprising the first reference electrode 8 and the second electrode 9 are placed in contact with charged particles in the flame 6 produced. In addition, the conductive burner 1 comprises a metal such as stainless steel, which can be used at high temperature. The flame rod 7 comprises also a metal wire of about 2 mm in diameter such as stainless steel. Various characteristics described hereinafter were measured with a domestic kerosene stove equipped with the apparatus for flame detection according to the present invention.

A power source 10 and current detecting means 11 are coupled in series between the flame rod 7 and the burner 1. The flame 6 comprises an inside flame 6*a* and an outside flame 6*b*. Inside flame 6*a* is produced on the burner 1 by combustion of pre-mixed primary air with evaporated fuel gas and contains many charged particles (electrons and ions). Outside flame 6*b* is produced at the outside of flame 6*a* by combustion of both residual fuel gas and secondary air in the surroundings. Flame 6*b* contains less charged particles than flame 6*a*. When the burner 1 comprises many burner ports 2 apart from each other at some millimeter interval as shown in FIG. 1, the many inside flames 6*a* are also produced apart from each other at all input rates. On the other hand, although many outside flames 6*b* are produced at a low input rate, one outside flame 6*b* is produced at a high input rate because each outside flame 6*b* grows largely with the increase in input rate and many outside flames 6*b* are combined. However, when the burner 1 comprises a great many burner ports 2 adjacent to each other at an interval below 1 mm, one inside flame 6*a* and one outside flame 6*b* are substantially produced at all practical input rates. This type of the burner 1 is called a surface combustion burner, and are conventionally used as a metal netting burner, Schwank burner and others. Although various characteristics described hereinafter were measured with the former type of burner 1, similar characteristics were also obtained with the latter type of burner 1.

When a voltage is applied between the flame rod 7 and the burner 1, a current $I_{fr}$ flows between them due to the presence of charged particles. At this time, since potential drops from the flame rod 7 to the burner 1, there exist equi-potential planes between them. The first reference electrode 8 contacts one of the equi-potential planes and the second reference electrode 9 contacts another equi-potential plane. As a result, first potential difference $V_{12}$ is detected between a pair of reference electrodes 8 and 9 by a first potential difference detecting means 12, which is coupled between the pair of reference electrodes 8 and 9. The first potential difference $V_{12}$ and current $I_{fr}$ are processed by a first processing means 13. The second potential difference $V_{2b}$ can be also detected between the second reference electrode 9 and the burner 1 by a second potential difference detecting means 14, which is coupled between the second reference electrode 9 and the burner 1. The second potential difference $V_{2b}$ and current $I_{fr}$ are also processed by a second processing means 15. These data processes will be apparent in the following description. In addition, various quantities such as $V_{fr}$, $I_{fr}$, $V_{12}$ and $V_{2b}$ were measured at the same time under the various conditions of combustion. Although detecting means of $V_{fr}$ is not shown in FIG. 1 to simplify the figure, $V_{fr}$ is apparent to be easily measured.

It is preferable that an electrometer having a very high input impedance over $10^{11}\Omega$ is used as the first potential difference detecting means 12 and the second 14 potential difference detecting means because the maximum voltage of $V_{12}$ and $V_{2b}$ can be obtained. On the other hand, when a conventional electric circuit used in a domestic product is used as the first potential difference detecting means 12 and the second 14 potential difference detecting means, it is preferable that a fixed resistor is connected both between the first reference electrode 8 and second 9 reference electrode and between the second 9 reference electrode and the burner 1, respectively. Considering that the insulating resistance becomes conventionally lower to about 10 MΩ owing to condensed water in the domestic electric circuit, it is preferable that the fixed resistor is below 1 MΩ although the voltage of $V_{12}$ and $V_{2b}$ becomes lower. In the following description, the voltage of $V_{12}$ and $V_{2b}$ was the voltage measured at the both ends of the fixed resistor of 1 MΩ, respectively. In addition, a capacitor of 5 μF was also connected in parallel with each 1 MΩ fixed resistor to eliminate noise.

Figure 2:
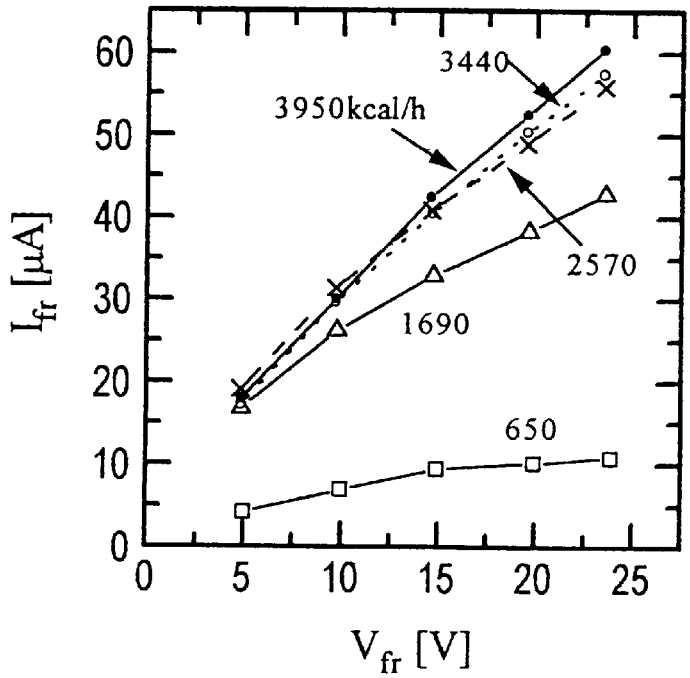
FIG. 2 is a graph showing current as a function of applied voltage in the normal combustion of kerosene containing no silicone compound. In the following description, kerosene containing no silicone compound is simply described as kerosene except for the particular description.
Figure 3:
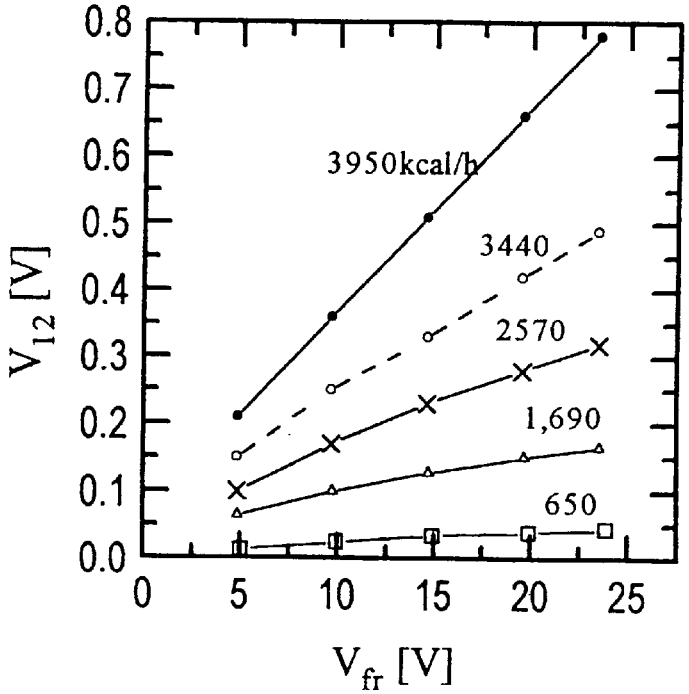
FIG. 3 is a graph showing a first potential difference as a function of applied voltage in the normal combustion of kerosene.

The $V_{fr}$-$I_{fr}$ and $V_{fr}$- $V_{12}$ characteristics measured under the various input rates in the normal combustion of kerosene containing no silicone compound are shown in FIGS. 2 and 3. In the following description, kerosene containing no silicone compound is simply described as kerosene except for the particular description. As shown in FIG. 2, $I_{fr}$ does not increase linearly with the increase of $V_{fr}$. This result indicates that the flame impedance between the flame rod 7 and the burner 1 is not ohmic. On the other hand, the first potential difference $V_{12}$ increased almost linearly with the increase of $V_{fr}$. This result suggests that the first flame impedance between the first reference electrode 8 and the second 9 reference electrode is almost ohmic. This finding is confirmed by the following FIGS. 4(*a*) and 4(*b*).

Figure 4:
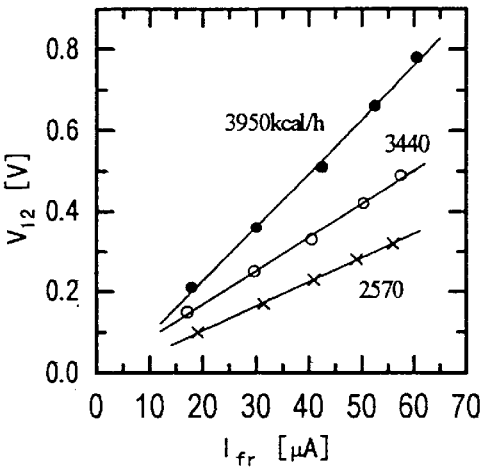
FIGS. 4(*a*) and 4(*b*) are graphs showing a first potential difference as a function of current at an input rate of (3950–2570)kcal/h and (1690–650)kcal/h, respectively, in the normal combustion of kerosene.
Figure 4:
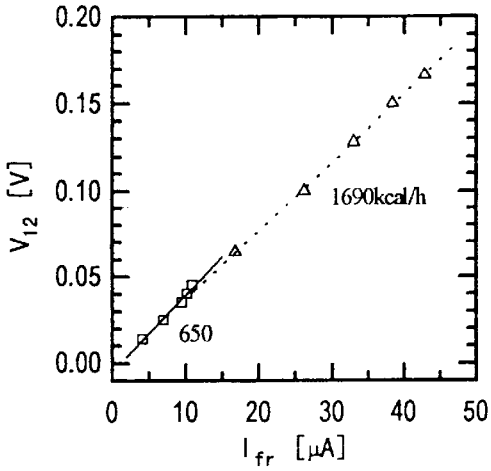

The $I_{fr}$ -$V_{12}$ characteristics are shown in FIGS. 4(*a*) and 4(*b*). FIGS. 4(*a*) and 4(*b*) show the characteristics at (3950–2570)kcal/h and (1690–650)kcal/h input rates, respectively, in the normal combustion of kerosene. In the figures, the straight lines (solid and dotted) are the lines obtained by linear fitting. For example, the line is represented by the equation ($V_{12}$=0.0133$I_{fr}$–0.0383) at 3950 kcal/h, where units of $V_{12}$ and the intercept, $I_{fr}$ and the slope are [v], [μA] and [MΩ], respectively. The values of $V_{12}$ calculated by applying various $I_{fr}$ to the linearly fitted equation agreed accurately with the measured $V_{12}$ within ±5%. The same agreements were also obtained at various input rates. The linearly fitted equation is expressed in general by eq.(1 ).

$$V_{12}=V_{120}+R_{12dc}I_{fr} \tag{1}$$

where units of $V_{12}$ and $V_{120}$, $R_{12dc}$ and $I_{fr}$ are [v], [MΩ] and [μA], respectively. We define the intercept $V_{120}$ and the slope $R_{12dc}$ as the first intercept and the linearly fitted first dynamic flame impedance, respectively. The reason why eq.(1) does not intersect the origin is unknown in detail. However, it may be attributed to the plasma potential.

Since $V_{120}$ can be measured beforehand in an combustion apparatus as shown in FIGS. 4(*a*) and 4(*b*), a measured first dynamic flame impedance $R_{12d}$ can be calculated according to eq.(2) by measuring $I_{fr}$ and $V_{12}$ with this $V_{120}$ at a required time. In addition, the measured first dynamic flame impedance is represented simply as the first dynamic impedance in the following description. The same representation will be used with regarding to the measured second and third dynamic flame impedances.

$$R_{12d}=(V_{12}-V_{120})/I_{fr} \tag{2}$$

A mean flame impedance $R_{fr}$ and an apparent first dynamic flame impedance $R_{12a}$ are also defined by eqs.(3) and (4) using measured values of $V_{fr}$, $I_{fr}$ and $V_{12}$, respectively, as shown below.

$$R_{fr}=V_{fr}/I_{fr} \tag{3}$$

$$R_{12a}=V_{12}/I_{fr} \tag{4}$$

In the present invention, the first dynamic $R_{12d}$ and apparent first dynamic $R_{12a}$ flame impedances are easily obtained by processing of measured $I_{fr}$ and $V_{12}$ according to eqs.(2) and (4) with the first processing means 13, in which $V_{120}$ is kept in memory.

A large inside flame 6*a* is produced overall between the flame rod 7 and the burner 1 at a high input rate and a small inside flame 6*a* is produced only near the burner 1 at a low input rate. Needless to say, the flame 6 is not also uniform in temperature distribution. Since charged particles produced thermally are distributed in the flame 6 to a large extent, the flame conductivity is not always uniform in the flame 6. As a result, when a given voltage $V_{fr}$ is applied, a measured $I_{fr}$ is proportional to the reciprocal of $R_{fr}$ between the flame rod 7 and the burner 1. The apparent first dynamic flame impedance $R_{12a}$ agrees almost with the first dynamic flame impedance $R_{12d}$ if $V_{120} << V_{12}$. When a large $I_{fr}$ flows, $R_{12a}$ is almost equal to $R_{12d}$ because of a larger $V_{12}$ than $V_{120}$. However, when $I_{fr}$ becomes lower, $R_{12a}$ can not agree with $R_{12d}$ because $V_{120}$ can not be negligible in comparison with low $V_{12}$ measured at low $I_{fr}$.

Figure 5:
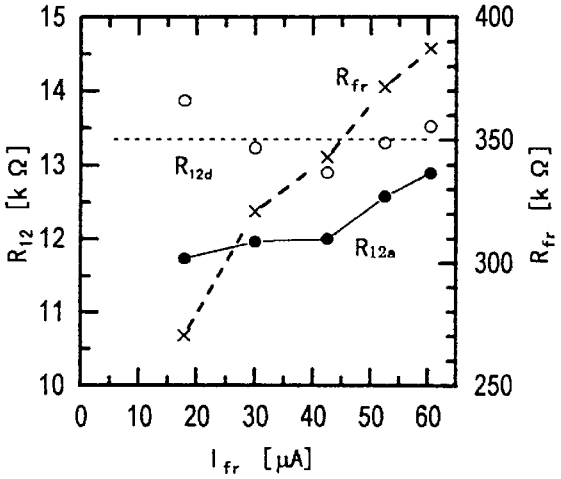
FIGS. 5(*a*) and 5(*b*) are graphs showing first dynamic, apparent first dynamic and mean flame impedances as a function of current at an input rate of 3950kcal/h and 650kcal/h, respectively, in the normal combustion of kerosene. These impedances were obtained by processing applied voltage, current, first potential difference and first intercept shown in FIGS. 2, 3, 4(*a*) and 4(*b*).
Figure 5:
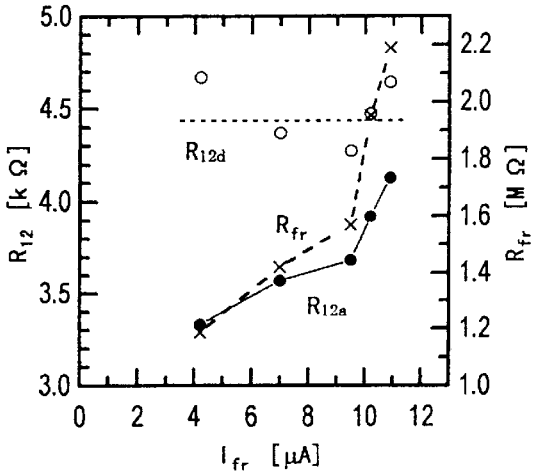

FIGS. 5(*a*) and 5(*b*) show $I_{fr}$- $R_{12d}$, $I_{fr}$-$R_{12a}$ and $I_{fr}$- $R_{fr}$ characteristics at 3950 kcal/h and 650 kcal/h, respectively in the normal combustion of kerosene. In FIG. 5, $R_{12d}$ shown by empty circles was calculated by applying the measured $V_{12}$ and $I_{fr}$ to eq.(2) with $V_{120}$=−0.0383V and $V_{120}$=−0.0056V at 3950 kcal/h and 650 kcal/h, respectively. The dotted lines show the slope ($R_{l2C}$=13.3kΩ and $R_{12dC}$=4.48kΩ at 3950 kcal/h and 650 kcal/h, respectively) obtained from linearly fitted equation in FIGS. 4(*a*)–4(*b*) and are apparent to be independent of $I_{fr}$. By applying measured $V_{fr}$ and $I_{fr}$ to eq. (3), $R_{fr}$ shown by black circles was calculated.

The current $I_{fr}$ dependence of $R_{fr}$ was the largest, as shown in FIGS. 5(*a*) and 5(*b*). For example, $R_{fr}$ was ~390kΩ and ~270kΩat $I_{fr}$=~60 μA and ~18 μA, respectively, at 3950 kcal/h. The former was about 1.44 times larger than the latter. However, comparing under the same $I_{fr}$ conditions, $R_{12a}$ was only about 1.07 times. The first dynamic flame impedance $R_{12d}$ was constant below ±5%. As described below, similar results were also obtained at 650 kcal/h. The mean flame impedance $R_{fr}$ was ~2.2 MΩ and ~1.2 MΩ at $I_{fr}$=~11 μA and ~4 μA, respectively. The former was about 1.83 times larger than the latter. However, comparing under the same $I_{fr}$ conditions, $R_{12a}$ was only about 1.23 times. The first dynamic impedance $R_{12d}$ was constant below ±6%. When the input rate is constant in normal combustion, it is apparently preferable that the flame impedance is also constant with independence from $I_{fr}$ or $V_{fr}$. This fact indicates that $R_{12a}$ and $R_{12d}$ are more suitable for flame detection than the conventional $R_{fr}$ or $I_{fr}$.

In addition, in the present exemplary embodiment, since $V_{120}$ was much lower than $V_{12}$ as shown in FIGS. 4(*a*) and 4(*b*), $R_{12a}$ was nearly equal to $R_{12d}$ below ±30% as shown in FIGS. 5(*a*) and 5(*b*). However, when the surface combustion burner 1 was used, $R_{12a}$ was very different from $R_{12d}$ because $V_{120}$ became higher and was not negligible in comparison with $V_{12}$. In this case, $R_{12d}$ is more suitable to detect flame. The first intercept $V_{120}$ depended on the construction of the burner 1. It is preferable to be determined according to the construction of the burner 1 whether $R_{12a}$ should be used or $R_{12d}$. If possible, since $V_{120}$ is not required to be measured beforehand, it is more preferable that $R_{12a}$ can be used. The similar results are confirmed with regarding to the second intercept $V_{2b0}$ described hereinafter.

Figure 6:
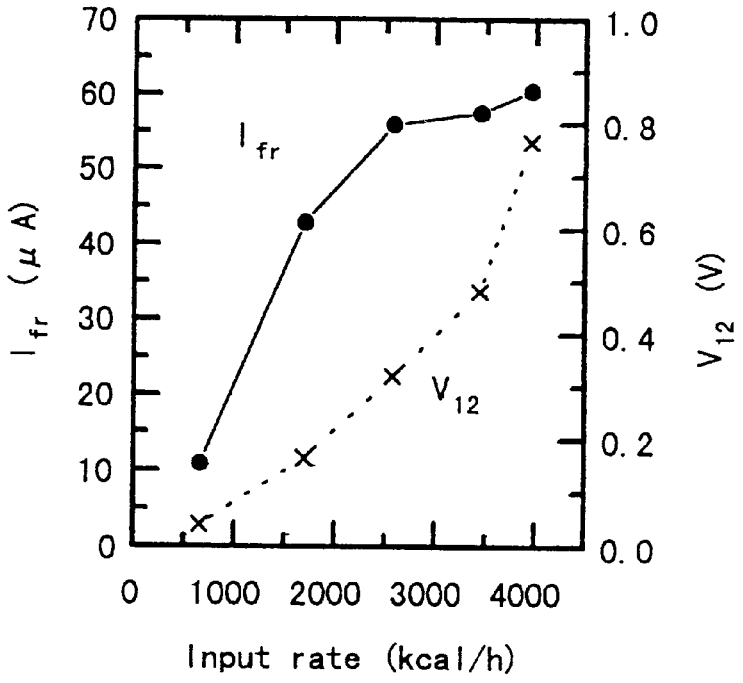
FIG. 6 is a graph showing current and a first potential difference as a function of input rate at $V_{fr}$=24V in the normal combustion of kerosene.
Figure 7:
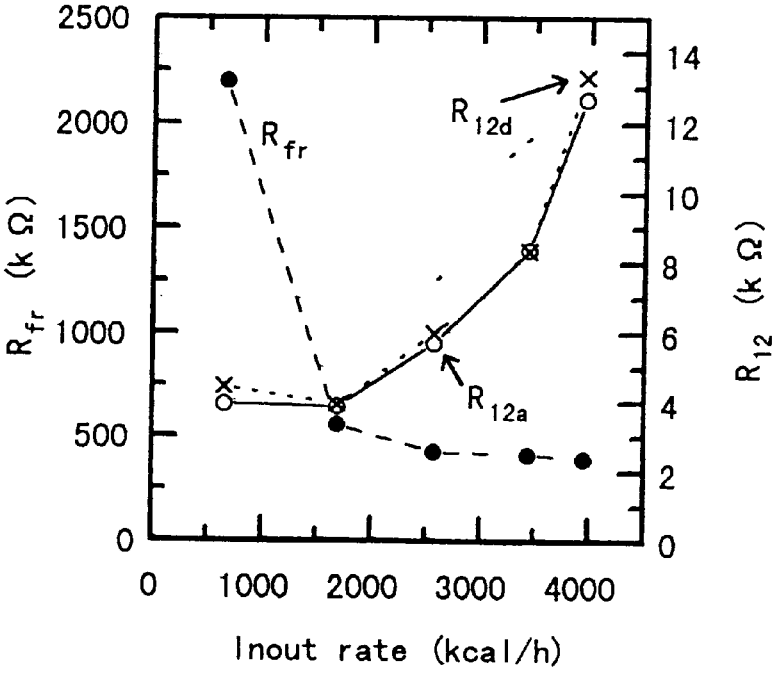
FIG. 7 is a graph showing first and mean flame impedances as a function of input rate at $V_{fr}$=24V. These impedances were obtained by processing current and the first potential difference shown in FIG. 6.

The input rate dependencies of $I_{fr}$ and $V_{12}$ are shown in FIG. 6 under the condition of a given applied voltage ($V_{fr}$=DC24V) in the normal combustion of kerosene. Both $I_{fr}$ and $V_{12}$ were decreased with the decrease of the input rate. The input rate dependencies of the various flame impedance described above are shown in FIG. 7. The mean flame impedance $R_{fr}$ increased with the decrease of input rate. In particular, it increased rapidly below about 1650 kcal/h. As a result, $R_{fr}$ at 650 kcal/h was above about 5.6 times larger than that at 3950 kcal/h. It is expected that $R_{fr}$ will be increased rapidly over 3 MΩ at a lower input rate below 650 kcal/h. This fact suggests that $R_{fr}$ is not practical for flame detection at lower input rate because the insulating resistance becomes lower to about 10 MΩ owing to condensed water in the domestic electric circuit as described above.

On the other hand, both $R_{12a}$ and $R_{12d}$ showed the smaller input rate dependencies in comparison with that of $R_{fr}$ although they decreased with the decrease of input rate. Both $R_{12a}$ and $R_{12d}$ at 3950 kcal/h were below 2.5 times larger than those at 650 kcal/h. In particular, it is practically preferable that their input rate dependencies were small in the lower input rate range than about 1690 kcal/h because they are expected to be small enough to be easily detected even at a lower input rate below 650 kcal/h with the domestic electric circuit. As shown from the above description, it is apparent that $R_{12a}$ and $R_{12d}$ are preferable for detecting the flame 6 over a wide range of input rates in comparison with conventional $R_{fr}$ or $I_{fr}$.

The stability of the present apparatus shown in FIG. 1 to formation of an insulating silicon oxide was confirmed as follows. The set of $I_{fr}$ and $V_{12}$ was continuously measured and various flame impedances $R_{fr}$, $R_{12a}$ and $R_{12d}$ were continuously evaluated according to eqs. (3), (4) and (2), respectively, for a given time at a constant applied voltage ($V_{fr}$=DC24V) during combustion of kerosene containing 200 ppm silicone oil in weight using a domestic oil stove equipped with the construction according to present flame detection. The measurements were carried out with the same electric circuit as that used in measurements of FIG. 2. White materials were found on surfaces of both the flame rod 7 and the burner 1 after the measurements. Since the white materials were found to be composed of silicon and oxygen from X-ray micro-analysis, the silicon oxide was confirmed to be formed during combustion. In addition, no ill effects of the added silicone oil on combustion was electrically observed. This will be described below in detail.

Figure 8A:
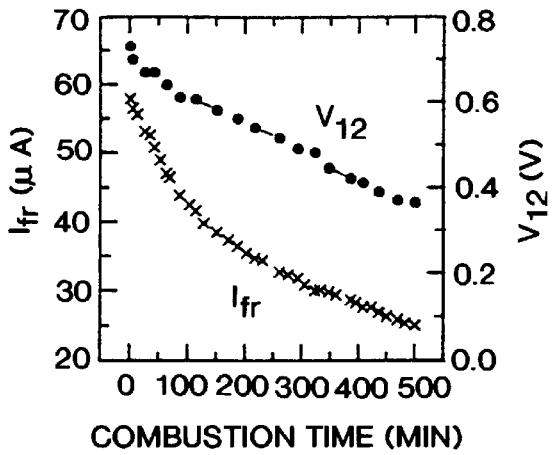
FIGS. 8(*a*) and 8(*b*) are graphs showing current and first potential difference as a function of combustion time at $V_{fr}$=24V during combustion of kerosene containing 200 ppm silicone oil at an input rate of 3950 kcal/h and 650 kcal/h, respectively.
Figure 8B:
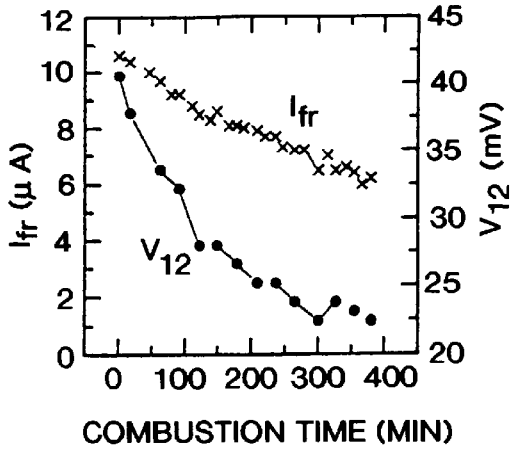
Figure 9A:
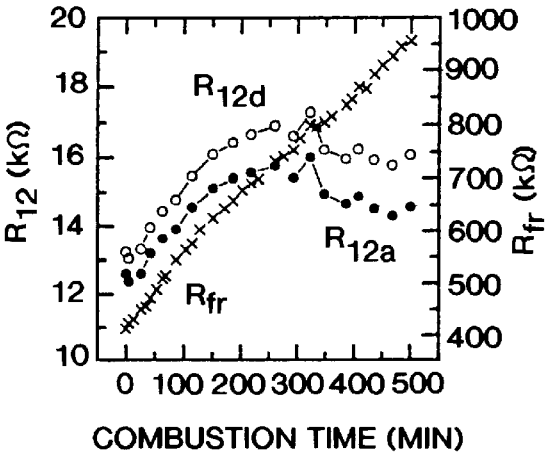
FIGS. 9(*a*) and 9(*b*) are graphs showing first dynamic, apparent first dynamic and mean flame impedances as a function of combustion time at an input rate of 3950 kcal/h and 650 kcal/h, respectively. These impedances were obtained by processing current and first potential difference shown in FIGS. 8(*a*) and 8(*b*).
Figure 9B:
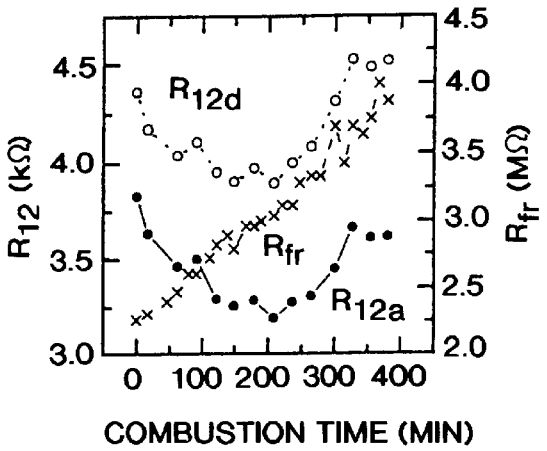
Figure 10:
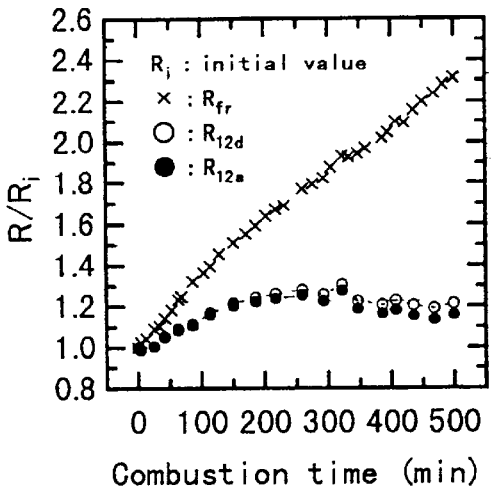
FIGS. 10(*a*) and 10(*b*) are graphs showing ratios of first dynamic, apparent first dynamic and mean flame impedance to their initial values as a function of combustion time at an input rate of 3950 kcal/h and 650 kcal/h, respectively. These ratios were obtained by processing various impedances shown in FIG. 9.
Figure 10:
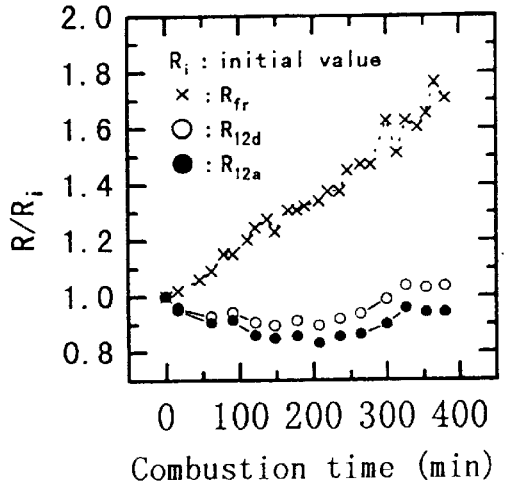

The combustion time dependencies of $I_{fr}$ and $V_{12}$ are shown in FIGS. 8 (*a*) and 8(*b*) where the input rates were 3950 kcal/h and 650 kcal/h, respectively. Since the insulating silicon oxide was gradually formed on surfaces of both the flame rod 7 and the burner 1 with an increase of combustion time, both $I_{fr}$ and $V_{12}$ decreased gradually with the increase of combustion time. The combustion time dependencies of $R_{fr}$, $R_{12a}$ and $R_{12d}$ are shown in FIGS. 9(*a*) and 9(*b*). The plotted values of $R_{fr}$, $R_{12}$ and $R_{12d}$ were calculated by applying the measured $I_{fr}$ and $V_{12}$ during the above combustion to eqs. (3), (4) and (2), respectively. At this time, $V_{120}$ was the value measured beforehand (see FIGS. 4(*a*) and 4(*b*)). To compare their combustion time dependencies, various ratios of the various flame impedances to the initial values are shown in FIGS. 10 (*a*) and 10(*b*). From FIGS. 9(*a*) and 9(*b*) and 10(*a*) and 10(*b*), it is apparent that both $R_{12a}$ and $R_{12d}$ are greatly stable to the insulating silicon oxide in comparison with the conventional $R_{fr}$. Needless to say, it is apparently preferable that the flame impedance for flame detection is independent of the insulating silicon oxide.

Figure 11:
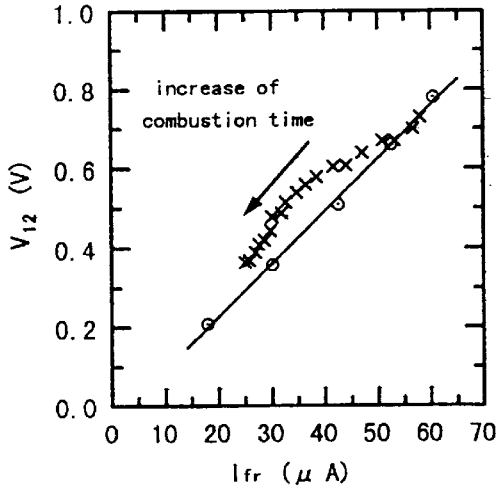
FIGS. 11(*a*) and 11(*b*) are graphs showing first potential difference as a function of current during the above combustion shown in FIGS. 8(*a*) and 8(*b*) and that in the initial normal combustion of kerosene at an input rate of 3950 kcal/h and 650 kcal/h, respectively.
Figure 11:
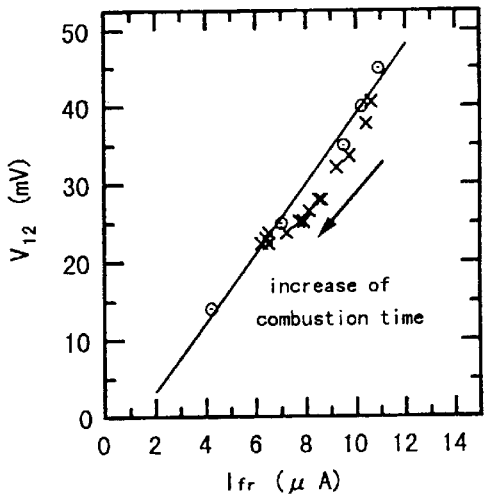

The reason why $R_{12d}$ is stable to the insulating silicon oxide is unknown in detail. However, as shown in FIG. 11, it has been found that the $I_{fr}$-$V_{12}$ characteristic measured during the above combustion containing silicone oil agreed nearly with the initial $I_{fr}$-$V_{12}$ characteristic measured in normal combustion containing no silicone oil. FIGS. 11(*a*) and 11(*b*) show the $I_{fr}$-$V_{12}$ characteristics at 3950 kcal/h and 650 kcal/h, respectively. This finding may indicate that the potential drop between the first reference electrode 8 and the second 9 reference electrode depends nearly only on $I_{fr}$ and may be determined according to eq. (1). As a result, whether the decrease of $I_{fr}$ is due to a decrease of $V_{fr}$ as shown in FIG. 2 or due to the insulating silicon oxide as shown in FIGS. 8(*a*) and 8(*b*), the effect of the decrease of $I_{fr}$ on $V_{12}$ is nearly equivalent. The stability of $R_{12d}$ may be attributed to this property in the $I_{fr}$-$V_{12}$ characteristic. Considering that the flame impedance is essentially subject to density, charge and mobility of charged particles, the stability of $R_{12d}$ to the insulating silicon oxide also suggests that the combustion containing silicone oil is nearly same to the normal combustion in the electrical properties. If silicone oil is thermally decomposed and new charged particles are formed in the flame 6 to some extent, the flame impedance is expected to decrease to the same extent. In addition, $R_{12a}$ was also stable to a similar extent as $R_{12d}$. This result may be attributed to the smaller $V_{120}$ than the measured $V_{12}$ in the above measurements. For example, $V_{120}$=−0.0383V at 3950 kcal/h was very much smaller than the final $V_{12}$~0.4V (see FIGS. 8(*a*) or 11(*a*)). At 650 kcal/h, $V_{120}$=−0.0056V is smaller to some extent than the final $V_{12}$~0.02V (see FIGS. 8(*b*) or 11(*b*)).

Figure 12A:
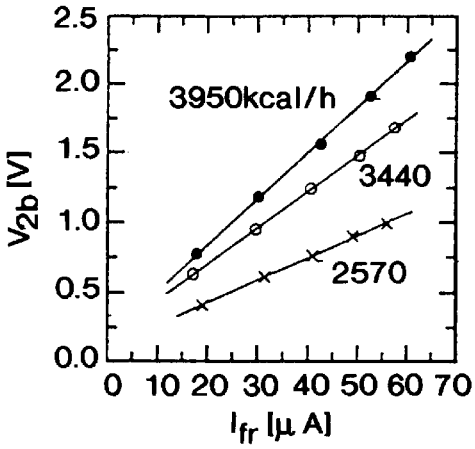
FIGS. 12(*a*) and 12(*b*) are graphs showing second potential difference as a function of current at input rate of (3950–2570) kcal/h and (1690–650)kcal/h, respectively, in normal combustion of kerosene.
Figure 12B:
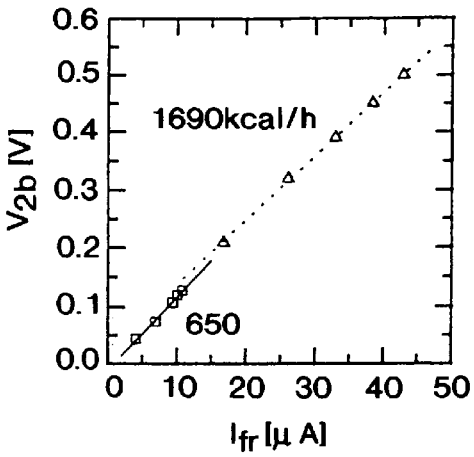

The $I_{fr}$- $V_{2b}$ characteristics measured in the normal combustion of kerosene are shown in FIGS. 12(*a*) and 12(*b*). FIGS. 12(*a*) and 12(*b*) show the characteristics at (3950–2570)kcal/h and at (1690–650)kcal/h in input rate, respectively. In the figures, the straight lines (solid and dotted) are the lines obtained by linear fitting. These characteristics were measured at the same time together with the $I_{fr}$-$V_{12}$ characteristics shown in FIGS. 4(*a*) and 4(*b*). So, the current $I_{fr}$ is the same to that shown in FIGS. 4(*a*) and 4(*b*). The $I_{fr}$-$V_{2b}$ characteristics indicated also as good linearity as the $I_{fr}$-$V_{12}$ characteristics. This result indicates that the apparent second dynamic $R_{2ba}$ and second dynamic $R_{2bd}$ flame impedances are reasonably defined as follows using measured values of $V_{2b}$ and $I_{fr}$.

$$R_{2ba}=V_{2b}/I_{fr} \tag{5}$$

$$R_{2bd}=(V_{2b}-V_{2b0})/I_{fr} \tag{6}$$

where $V_{2b0}$ is defined as the second intercept and can be calculated beforehand from linear fitting of $I_{fr}$-$V_{2b}$ characteristics, as similarly as $V_{120}$. Units of $V_{2b}$ and $V_{2b0}$, $R_{2ba}$ and $R_{2bd}$, and $I_{fr}$ are [V], [MΩ] and [μA], respectively. In the present invention, the second dynamic $R_{2bd}$ and apparent second dynamic $R_{2ba}$ impedances are easily obtained by processing of measured $I_{fr}$ and $V_{2b}$ according to eqs.(5) and (6) with the second processing means 15, in which $V_{2b0}$ is keep in memory.

Since $V_{2b}$ is the potential difference between the potential of the second reference electrode 9 and that of the burner 1, it shows how far the equi-potential plane contacting with the second reference electrode 9 is placed electrically apart from the burner 1. It was found that the equi-potential plane was electrically adjacent to the burner 1 because the ratio of $V_{2b}/V_{fr}$ was lower than 0.1. This fact implies that $V_{2b}$ is the potential difference in the flame 6 near the burner 1. Here we discuss the ratio $V_{1b}/V_{fr}$, where $V_{1b}$ is the potential difference between the first reference electrode 8 and the burner 1 and easily calculated according to $V_{1b}=V_{12}+V_{2b}$. The ratio $V_{1b}/V_{fr}$ was lower than 0.15. Considering that $V_{1b}$ shows how far the equi-potential plane contacting the first reference electrode 8 is placed electrically apart from the burner 1, the equi-potential plane was also electrically adjacent to the burner 1 although it was a little apart from the position of the equi-potential plane contacting the second reference electrode 9. This fact indicates that $V_{12}$ is also the potential difference in the flame 6 near the burner 1 and therefore $R_{12d}$ is the flame impedance in the flame 6 near the burner 1.

Figure 13A:
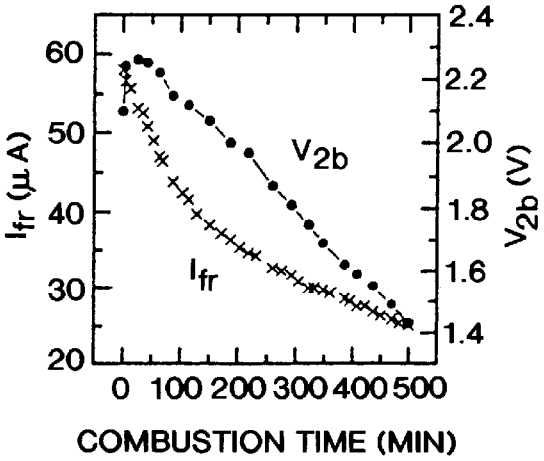
FIGS. 13(*a*) and 13(*b*) are graphs showing current and second potential difference as a function of combustion time during combustion at $V_{fr}$=24V during combustion of kerosene containing 200 ppm silicone oil at an input rate of 3950 kcal/h and 650 kcal/h, respectively.
Figure 13B:
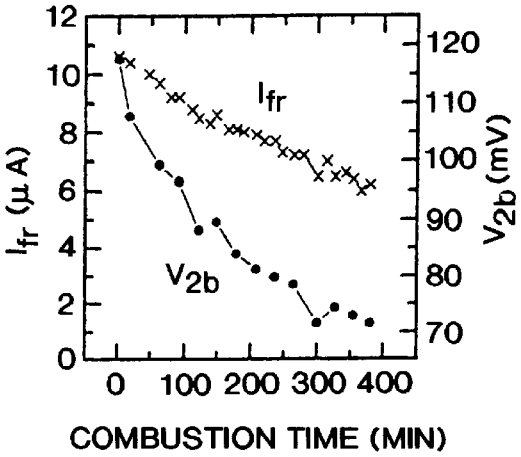
Figure 14:
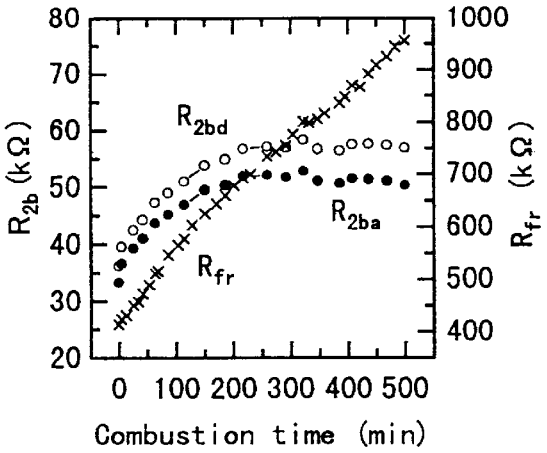
FIGS. 14(*a*) and 14(*b*) are graphs showing second dynamic, apparent second dynamic and mean flame impedances as a function of combustion time during combustion at input rate of 3950 kcal/h and 650 kcal/h, respectively. These impedances were obtained by processing the current and first potential difference shown in FIGS. 13(*a*) and 13(*b*).
Figure 14:
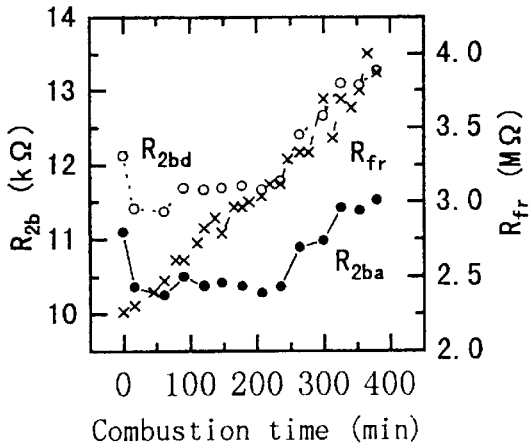
Figure 15:
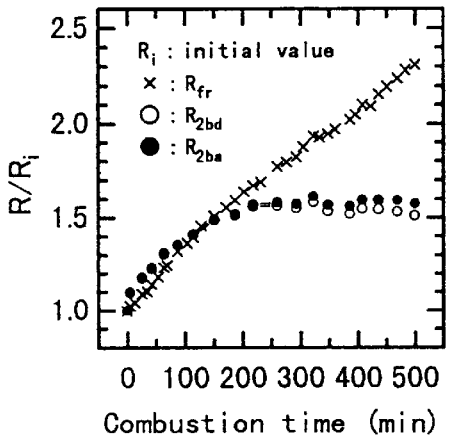
FIGS. 15(*a*) and 15(*b*) are graphs showing ratios of second dynamic apparent second dynamic and mean flame impedance to their initial value as a function of combustion time during combustion at input rate of 3950 kcal/h and 650 kcal/h, respectively. These ratios were obtained by processing the various flame impedance shown in FIGS. 14(*a*) and 14(*b*).
Figure 15:
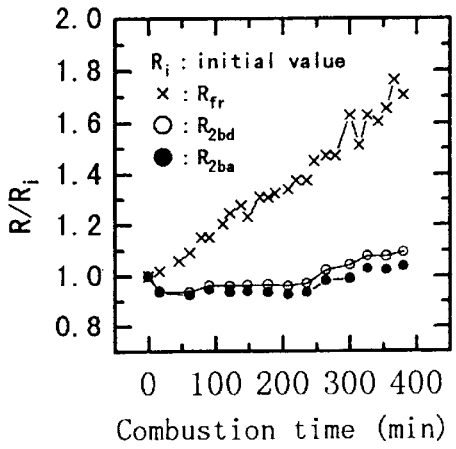

During combustion of kerosene containing 200 ppm silicone oil, the combustion time dependencies of $I_{fr}$ and $V_{2b}$ are shown in FIGS. 13(*a*) and 13(*b*) when input rates were 3950 kcal/h and 650 kcal/h, respectively. The combustion time dependencies of $R_{fr}$, $R_{2ba}$ and $R_{2bd}$ are shown in FIGS. 14(*a*) and 14(*b*). The plotted values of $R_{fr}$, $R_{2ba}$ and $R_{2bd}$ were calculated by applying the measured $I_{fr}$ and $V_{12}$ during the above combustion to eqs. (3), (5) and (6), respectively. At this time, $V_{2b0}$ was the value measured beforehand (see FIGS. 12(*a*) and 12(*b*)). To compare their combustion time dependencies, various ratios of the various flame impedances to the initial values are shown in FIGS. 15(*a*) and 15(*b*). In addition, since these characteristics were measured at the same time together with those shown in FIGS. 8(*a*) and 8(*b*), the characteristics regarding to $I_{fr}$ and $R_{fr}$ are the same to those shown in FIGS. 8(*a*)–10(*b*).

Although $V_{2b}$ decreased with decrease of $I_{fr}$ as similarly as $V_{12}$ shown in FIGS. 8(*a*) and 8(*b*), it was characteristic that both $R_{2bd}$ and $R_{2ba}$ increased to a large extent at 3950 kcal/h, as shown in FIG. 14(*a*). After both $R_{2bd}$ and $R_{2ba}$ increased rapidly in the initial combustion time to a similar extent as $R_{fr}$, they were saturated at increment of about 50% after about 200 min. The reason why $R_{2bd}$ and $R_{2ba}$ increased is unknown in detail. However, since the insulating silicon oxide was apparently formed on surface of the burner 1, a large potential drop must be present near the burner 1. Since $V_{2b}$ includes this large potential drop near the burner 2, both $R_{2bd}$ and $R_{2ba}$ are considered to be increased.

When $R_{fr}$ increased to a large extent due to the silicon oxide formed both on surfaces of both the burner 1 and the flame rod 7 during combustion, $R_{12d}$ and $R_{12a}$ changed to a small extent below ±20% (see FIGS. 9 or 10) and both $R_{2bd}$ and $R_{2ba}$ were increased at 3950 kcal/h to a large extent. This result indicates that it is possible to detect the silicon oxide by monitoring both $R_{12}$ ($R_{12d}$ or $R_{12a}$) and $R_{2b}$ ($R_{2bd}$ or $R_{2ba}$) at the same time. When a small change in $R_{12}$ and a large increase in $R_{2b}$ are observed, they are attributed to the silicon oxide and combustion is normal. In this case, combustion can be kept continuously. However, when a large change above ±20% in $R_{12}$ is observed, it may be possibly attributed to combustion deviated from normal combustion. For example, when input rate was 2530 kcal/h, $R_{12d}$ was minimum at A/F~1, where the ratio A/F is air-fuel gas ratio. However, $R_{12d}$ at A/F~1.2 and A/F~0.7 was about 4.3 times and about 4 times larger that that at A/F~1, respectively, when input rate was 650 kcal/h, $R_{12d}$ was minimum at A/F~1.2. However, $R_{12d}$ at A/F~1.4 and A/F~0.8 was about 2.3 times and about 2.7 times larger that that at A/F~1, respectively. In this case, combustion may be stopped to maintain safety. It is apparently preferable that both $R_{12}$ and $R_{2b}$ are monitored at the same time because it can be distinguished whether increase of $R_{fr}$ or decrease of $I_{fr}$ is due to the silicon oxide or due to deviation from normal combustion.

Figure 16:
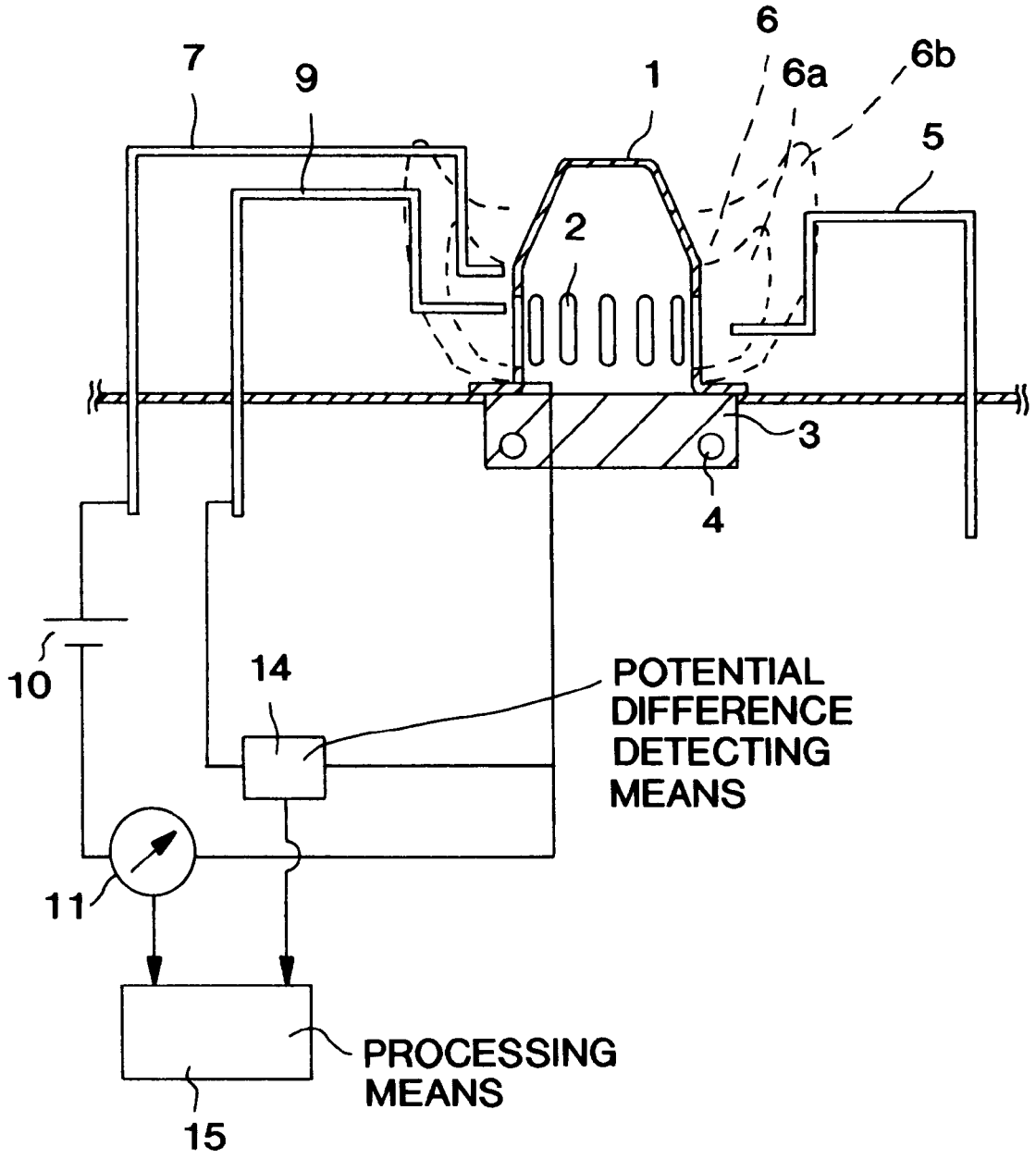
FIG. 16 is a cross-sectional view of an apparatus for flame detection according to a second exemplary embodiment of this invention.

On the other hand, it is very characteristic that the apparent increase of both $R_{2bd}$ and $R_{2ba}$ was not observed at 650 kcal/h in comparison with their behaviors at 3950 kcal/h. This fact suggests that the construction comprising one reference electrode, as shown in FIG. 16, is also available. During combustion at a given input rate, it is preferable that $R_{2bd}$ or $R_{2ba}$ is monitored sometimes both at 3950 kcal/h and 650 kcal/h at intervals of a suitable time. When $R_{2bd}$ or $R_{2ba}$ is higher than the expected value at 3950 kcal/h and it is nearly equal to the initial 650 kcal/h, combustion is normal although the insulating silicon oxide is going to be formed. However, when $R_{2bd}$ or $R_{2ba}$ is higher than the expected value both at 3950 kcal/h and at 650 kcal/h, it may be possibly attributed to combustion deviated from normal combustion. For example, the A/F dependence of $R_{2bd}$ or $R_{2ba}$ was similar to that of $R_{12d}$ or $R_{12a}$. This embodiment is advantageous because of its simple construction in comparison with that shown in FIG. 1.

Figure 17A:
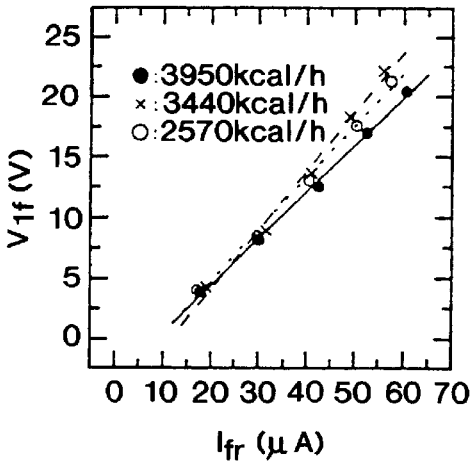
FIGS. 17(*a*) and 17(*b*) are graphs showing current and third potential difference as a function of current at input rate of (3950–2570)kcal/h and (1690–650)kcal/h, respectively, in the normal combustion of kerosene.
Figure 17B:
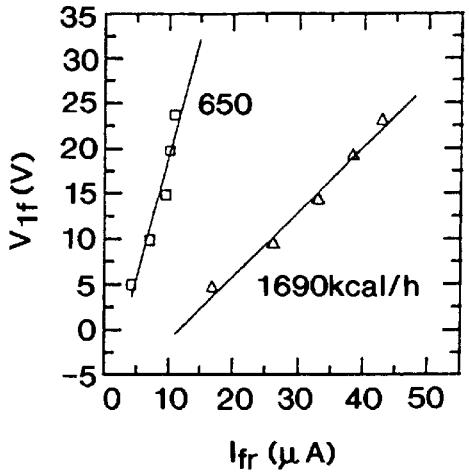

Now referring to FIG. 1 again, the third potential difference $V_{1f}$ is newly defined as that between the first reference electrode 8 and the flame rod 7. The $I_{fr}$-$V_{1f}$ characteristics in normal combustion of kerosene are shown in FIGS. 17(*a*) and 17(*b*), where $V_{1f}$ was calculated according to eq.(7).

$$V_{1f}=V_{fr}-V_{12}-V_{2b} \tag{7}$$

The characteristics indicated as good linearity as those in FIGS. 4(*a*) and 4(*b*), 12(*a*) and 12(*b*). This good linearity indicates that the apparent third dynamic $R_{1fa}$ and third dynamic $R_{1fd}$ flame impedances are reasonably defined as follow using the measured $I_{fr}$ and $V_{1f}$.

$$R_{1fa}=V_{1f}/I_{fr} \tag{8}$$

$$R_{1df}=(V_{1f}-V_{1f0})I_{fr} \tag{9}$$

where $V_{1f0}$ is defined as the third intercept and can be calculated beforehand from linear fitting of $I_{fr}$-$V_{1f}$ characteristics, as similarly as $V_{120}$. Units of $V_{1f}$ and $V_{1f0}$, $R_{1fa}$ and $R_{1fd}$, and $I_{fr}$ are [V], [MΩ] and [μA], respectively. In the present invention, the third dynamic $R_{1fd}$ and apparent third dynamic $R_{1fa}$ impedances are easily obtained by processing of measured $I_{fr}$ and $V_{1f}$ according to eqs.(8) and (9) with the third processing means 17, in which $V_{1f0}$ is kept in memory. In addition, except for calculation according to eq. 7, the third potential difference $V_{1f}$ can be also detected by a third potential difference detecting means 16.

Since $V_{1f}$ is the potential difference between the potential of the first reference electrode 8 and that of the flame rod 7, it shows how far the equi-potential plane contacting with the first reference electrode 8 is placed electrically apart from the flame rod 7. It was found that the equi-potential plane was electrically apart far from the flame rod 7 because the ratio of $V_{1f}/V_{fr}$ was above 0.85 and slightly less than 1. This implies that almost all of $V_{fr}$ was applied between the first reference electrode 8 and the flame rod 7.

Figure 18A:
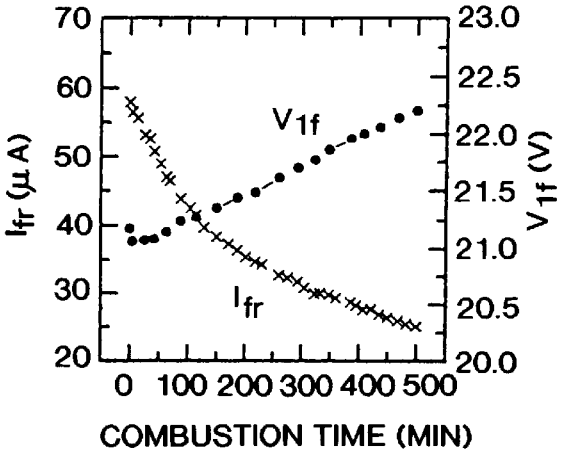
FIGS. 18(*a*) and 18(*b*) are graphs showing current and third potential difference as a function of combustion time at $V_{fr}$=24V during combustion of kerosene containing 200 ppm silicone oil at an input rate of 3950 kcal/h and 650 kcal/h, respectively.
Figure 18B:
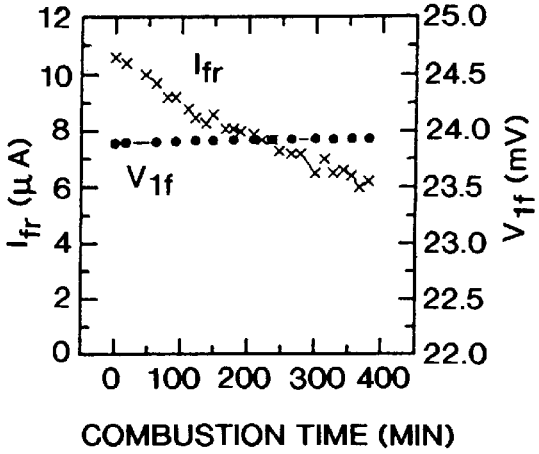
Figure 19A:
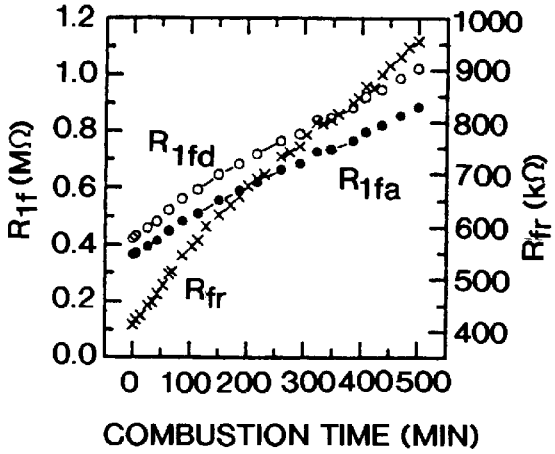
FIGS. 19(*a*) and 19(*b*) are graphs showing third dynamic, apparent third dynamic and mean flame impedances as a function of combustion time at input rate of 3950 kcal/h and 650 kcal/h, respectively. These impedances were obtained by processing current and first potential difference shown in FIGS. 18(*a*) and 18(*b*).
Figure 19B:
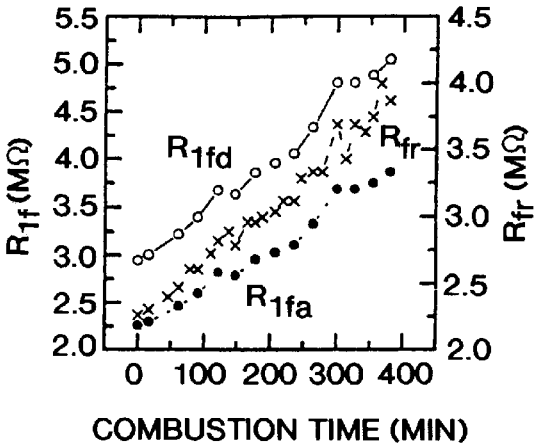
Figure 20A:
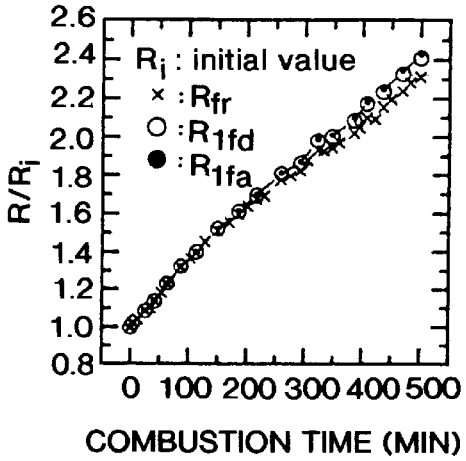
FIGS. 20(*a*) and 20(*b*) are graphs showing ratios of third dynamic, apparent third dynamic and mean flame impedances to their initial value as a function of combustion time during combustion at input rate of 3950 kcal/h and 650 kcal/h, respectively. These ratios were obtained by processing various impedances shown in FIGS. 19(*a*) and l9(*b*).
Figure 20B:
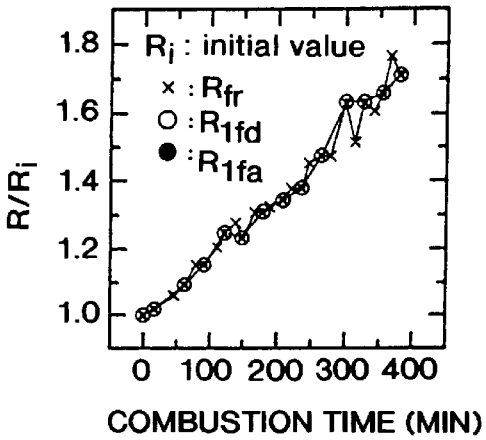

During combustion of kerosene containing 200 ppm silicone oil, the combustion time dependencies of $I_{fr}$ and $V_{1f}$ are shown in FIGS. 18(*a*) and 18(*b*) when input rates were 3950 kcal/h and 650 kcal/h, respectively. The combustion time dependencies of $R_{fr}$, $R_{1fa}$ and $R_{1fd}$ are shown in FIGS. 19(*a*) and 19(*b*). The plotted values of $R_{fr}$, $R_{1fa}$ and $R_{1fd}$ were calculated by applying the measured $I_{fr}$ and $V_{1f}$ during the above combustion to eqs. (3), (8) and (9), respectively. At this time, $V_{fb0}$ was the value measured beforehand (see FIG. 17). To compare their combustion time dependencies, various ratios of the various flame impedances to the initial values are shown in FIGS. 20(*a*) and 20(*b*). In addition, since these characteristics were measured at the same time together with those shown in FIGS. 8(*a*) and 8(*b*), the characteristics regarding to $I_{fr}$ and $R_{fr}$ are the same to those shown in FIGS. 8(*a*) through 10(*b*).

It is characteristic that both $R_{1fd}$ and $R_{1fa}$ increased to a large extent at both 3950 kcal/h and 650 kcal/h, as shown in FIGS. 19(*a*) and 19(*b*). The reason is unknown in detail. However, since the insulating silicon oxide was apparently formed on the surface of the flame rod 7, a large potential drop must be present near the flame rod 7. Since $V_{1f}$ includes the large potential drop near the flame rod 7, both $R_{1fa}$ and $R_{1fd}$ were considered to be increased.

When $R_{fr}$ increased to a large extent owing to the silicon oxide formed both on surface of both the burner 1 and the flame rod 7 during combustion, $R_{12d}$ and $R_{12a}$ changed to a small extent below ±20% (see FIGS. 9(*a*), 9(*b*), 10(*a*) or 10(*b*)) and both $R_{1fd}$ and $R_{1fa}$ increased largely to a similar extent as $R_{fr}$. This result indicates that it is possible to detect the silicon oxide by monitoring both $R_{12}$ ($R_{12d}$ or $R_{12a}$) and $R_{1f}$ ($R_{1fd}$ or $R_{1fa}$) at the same time. When a small change in $R_{12}$ and a large increase in $R_{1f}$ are observed, they are attributed to the silicon oxide and combustion is normal. In this case, combustion can be kept continuously. However, when an increase of $R_{12}$ is observed above ±20%, it may possibly be attributed to combustion deviated from normal combustion. For example, the A/F dependencies of $R_{1fa}$ and $R_{1fd}$ were similar to those of $R_{12a}$ and $R_{12a}$. In this case, combustion may be stopped to maintain safety. It is apparently preferable that both $R_{12}$ and $R_{1f}$ are monitored at the same time because it can be distinguished whether increase of $R_{fr}$ or decrease of $I_{fr}$ is due to the silicon oxide or due to deviation from normal combustion.

When an insulating burner 1 such as ceramic burner is used, the burner can not operate as an electrode. In this case, a conductive material is preferable to be placed near surface of the burner 1. To keep pressure loss owing to the conductive material as low as possible, thin and porous material such as stainless mesh is preferable as the conductive material.

When the flame rod 7 and the first 8 reference electrode and second 9 reference electrode are exposed to the flame 6 for a long time, their exposed ends are deformed. Since $I_{fr}$, $R_{12}$, $R_{2b}$ and $R_{1f}$ depend on each distance from said each end to the burner 1, it is preferable that the flame rod 7 and the first 8 reference electrode and second 9 reference electrode are arranged perpendicularly to the burner 1 to maintain said distance as precisely as possible even if said ends are deformed.

The position of the exposed ends of the flame rod 7 and the first reference electrode 8 and second 9 reference electrode to the burner 1 is not limited fundamentally. However, when the charged particles exist little around the exposed ends, the $I_{fr}$ is very small and the $V_{12}$ is difficult to be measured because of very high impedance between the exposed ends and the burner 1. So, it is preferable that the exposed ends are arranged above the burner ports 2, where many charged particles exist.

Figure 21:
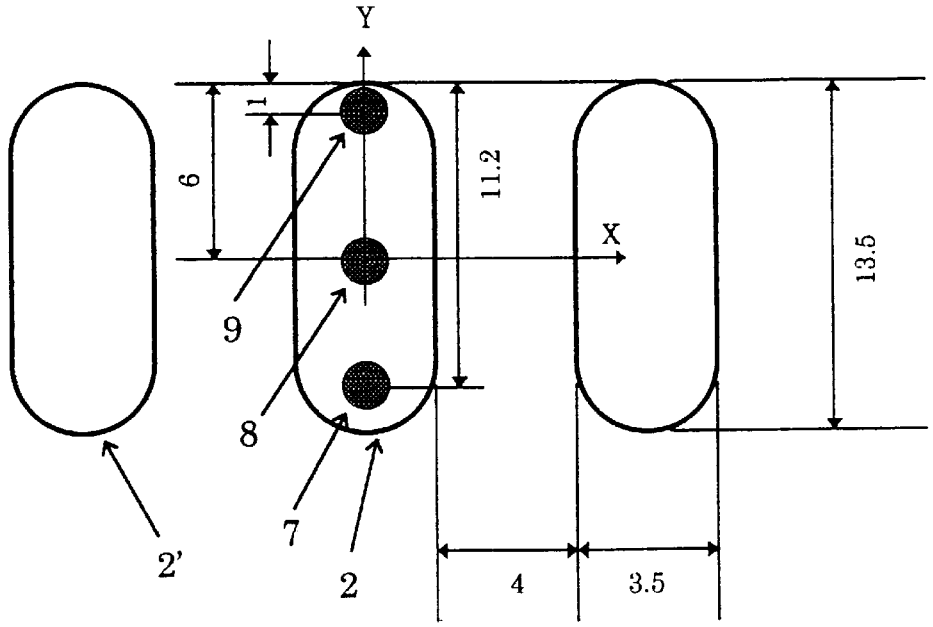
FIG. 21 is a view showing the arrangement of the flame rod, the first reference electrode and second reference electrode in detail.

When the burner 1 comprising many burner ports 2 arranged at the intervals of 4 mm was used, $V_{12}$ was measured as a function of the position of the exposed ends as follows. In addition, the burner port 2 was 3.5 mm in width and 13.5 mm height. Initially, the ends of the flame rod 7 and the first reference electrode 8 and second 9 reference electrode were arranged at 1 mm, 6 mm and 11.2 mm from the top edge of one burner port 2 in the Y-axis direction, respectively, as shown in FIG. 21. They were also arranged at the center of the burner port 2 in the X-axis direction and at 1.5 mm apart from the surface of the burner port 2 in the Z-axis direction (perpendicular direction to the sheet in FIG. 21). The standard first potential difference $V_{f2i}$ is defined as the $V_{12}$ measured at the initial position described above.

Figure 22:
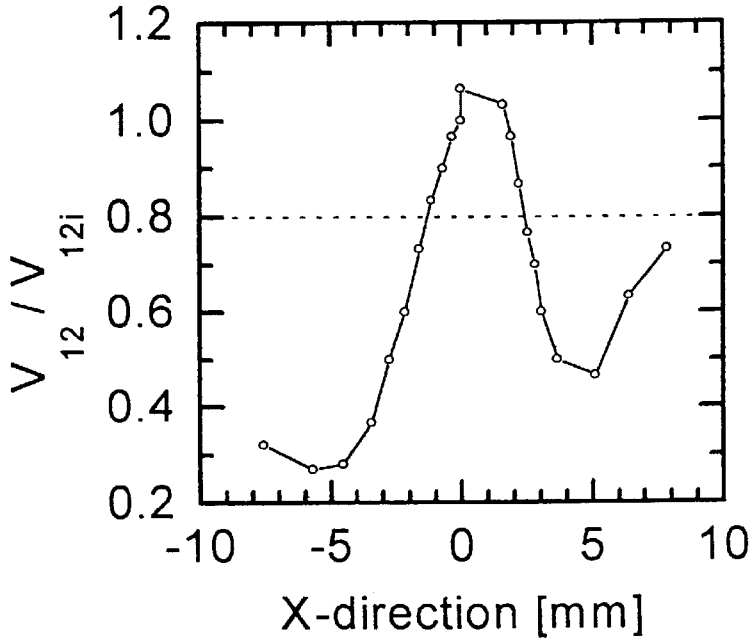
FIG. 22 is a graph showing the ratio $V_{12}$ /$V_{12i}$ as a function of the position of the first reference electrode in the X direction.

When only the first reference electrode 8 was moved in the X-axis direction at 2500 kcal/h while maintaining the other electrodes at the initial position, $V_{12}$ was changed with the movement. The ratio $V_{12}/V_{f2i}$ is shown as a function of the X-axis directional position in FIG. 22. The ratio $V_{12}/V_{12i}$ was maximum at the center of the burner port 2 (initial position) and minimum at the center between the burner port 2 and the neighboring burner port 2'. These results suggest that an amount of charged particles is maximum at the center of the burner port 2 and minimum at the center between two burner ports 2 and 2' neighboring each other. Since $V_{12}$ was changed to a small extent below ±20%, it is preferable that the end of the first reference electrode 8 was controlled to be arranged at the positional range of X<±1.75 mm. This preferable positional range nearly corresponds to the width of the burner port 2.

Figure 23:
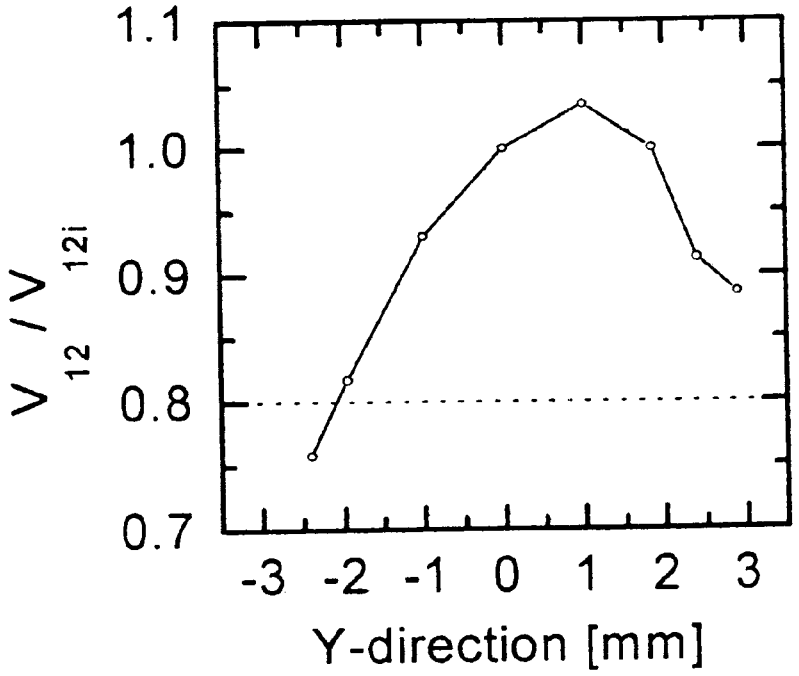
FIG. 23 is a graph showing the ratio $V_{12}$2/$V_{12i}$ as a function of the position of the first reference electrode in the Y direction.

When only the first reference electrode 8 was moved in the Y-axis direction at 2500 kcal/h with maintaining the other electrodes at the initial position, $V_{12}$ was also changed with this movement. The ratio $V_{12}/V_{12i}$ is shown as a function of the Y-axis directional position in FIG. 23. The ratio $V_{12}/V_{12i}$ was maximum not at the center of the burner port 2 (initial position, Y=0 mm) but at the position of Y~1 mm. Although this reason is unknown in detail, it may be attributed to the flow of the flame 6. Before and after the position of Y~1 mm, the ratio $V_{12}/V_{12i}$ was decreased gradually. This behavior may also be considered to correspond to the distribution of charged particles. Since $V_{12}$ was changed to a small extent below ±20%, it is preferable that the end of the first reference electrode was controlled to be arranged at the positional range of Y<±2 mm. This preferable positional range nearly corresponds to about 30% of the length of the burner port 2.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. An apparatus for detecting a flame for use with a conductive burner having a burner port, said conductive burner producing said flame having charged particles, said apparatus comprising:

a flame rod placed in contact with said charged particles, wherein a power source is electrically coupled between said flame rod and said conductive burner for supplying a voltage;

current detecting means coupled between said flame rod and said conductive burner for detecting a current;

a pair of reference electrodes in contact with said flame;

potential difference detecting means for detecting a potential difference between said pair of reference electrodes; and processing means for estimating a flame impedance based on said potential difference and said current.

2. An apparatus for flame detection in accordance with claim 1, wherein said processing means estimates a dynamic flame impedance defined as a ratio of said potential difference to said current.

3. An apparatus for flame detection in accordance with claim 1, wherein said processing means estimates a dynamic flame impedance defined as ratio of said potential difference subtracted by an intercept to said current, wherein said intercept corresponds to said potential difference when said current is zero.

4. An apparatus for flame detection in accordance with claim 1, wherein a first resistor is coupled between said pair of reference electrodes and a second resistor is coupled between one electrode of said pair of reference electrodes and said burner, the potential of said one electrode being lower than the potential of said second electrode.

5. An apparatus for flame detection in accordance with claim 4, wherein said first resistor and said second resistor each have a value less than 1 MΩ.

6. An apparatus for flame detection in accordance with claim 1, wherein said flame rod and said reference electrodes are oriented in a longitudinal direction with respect to said burner.

7. An apparatus for flame detection in accordance with claim 1, wherein said burner further comprises a plurality of burner ports; and an end of said flame rod and an end of each of said pair of reference electrodes are arranged above at least one of said plurality of said burner ports.

8. An apparatus for flame detection in accordance with claim 1, wherein equi-potential planes are formed between said flame rod and said burner when said voltage is applied between said flame rod and said burner, a first of said pair of reference electrodes contacting a first equi-potential plane, and a second of said pair of reference electrodes contacting a second equi-potential plane.

9. An apparatus for detecting a flame for use with a conductive burner having burner ports, said conductive burner producing said flame having charged particles, said apparatus comprising:

a flame rod placed in contact with said charged particles of said flame, wherein a power source is electrically coupled between said flame rod and said burner for supplying a voltage;

current detecting means coupled between said flame rod and said conductive burner for detecting a current;

a reference electrode placed in contact with said charged particles in said flame, said reference electrode in contact with a first equi-potential plane distributed between said flame rod and said burner when said voltage is applied between them;

potential difference detecting means for detecting a potential difference between said reference electrode and the conductive burner; and processing means for estimating a flame impedance based on said potential difference and said current.

10. An apparatus for flame detection in accordance with claim 9, wherein said potential difference is measured both at a high input fuel rate and a low input fuel rate at predetermined time intervals; and said processing means estimates said flame impedance based on said high input fuel rate and said low input fuel rate potential difference and said current.

11. An apparatus for flame detection in accordance with claim 10, wherein said processing means estimates a flame impedance defined as a ratio of said potential difference to said current.

12. An apparatus for flame detection in accordance with claim 10, wherein said processing means estimates a dynamic flame impedance defined as said potential difference subtracted by an intercept divided by said current, wherein said intercept corresponds said potential difference when said current is zero.

13. An apparatus for flame detection in accordance with claim 9, wherein said processing means estimates a flame impedance defined as a ratio of said potential difference to said current.

14. An apparatus for flame detection in accordance with claim 9, wherein said processing means estimates a dynamic flame impedance defined as ratio of said potential difference subtracted by an intercept to said current, wherein said intercept is said potential difference when said current is zero.

15. An apparatus for flame detection in accordance with claim 9, further comprising a second reference electrode placed in contact with said charged particles in said flame, wherein a first resistor is coupled between said first and second reference electrodes and a second resistor is coupled between a first one of said electrodes and said burner, a potential of said one electrode being lower than a potential of said second reference electrode.

16. An apparatus for flame detection in accordance with claim 9, further comprising a second reference electrode placed in contact with said charged particles in said flame, wherein said flame rod and said first and second reference electrodes are oriented in a longitudinal direction with respect to said burner.

17. An apparatus for flame detection in accordance with claim 9, wherein said burner further comprises a plurality of burner ports, further comprising a second reference electrode placed in contact with said charged particles in said flame; and an end of said flame rod and an end of each of said first and second reference electrodes are arranged above at least one of said plurality of burner ports.

18. An apparatus for flame detection for use with a conductive burner having burner ports, said conductive burner producing said flame having charge particles, said apparatus comprising:

a flame rod placed in contact with said charged particles of said flame, wherein a power source is electrically coupled between said flame rod and said burner for supplying a voltage;

current detecting means coupled between said flame rod and said burner for detecting a current;

a pair of reference electrodes placed in contact with said flame, a first reference electrode of said pair of reference electrodes in contact with a first equi-potential plane, and a second reference electrode of said pair of reference electrodes in contact with a second equi-potential plane, said first and second-equi-potential planes formed between said flame rod and said burner when said voltage is applied thereto;

first potential difference detecting means for detecting a first potential difference between said pair of reference electrodes;

first processing means for estimating a first flame impedance based on said first potential difference and said current;

second potential difference detecting means for detecting a second potential difference between said first reference electrode and said burner, a first potential of said first electrode being lower than a second potential of the second reference electrode; and second processing means for estimating a second flame impedance based on said second potential difference and said current.

19. An apparatus for flame detection in accordance with claim 18 wherein said second potential difference is measured both at a high input rate and a low input rate at a predetermined time interval.

20. An apparatus for flame detection in accordance with claim 19, wherein said first processing means estimates a first flame impedance defined as a ratio of said first potential reference to said current and said second processing means estimates a second flame impedance defined as a ratio of said second potential difference to said current.

21. An apparatus for flame detection in accordance with claim 19, wherein said first processing means estimates a first dynamic flame impedance defined as a ratio of a first compensated voltage to said current, said first compensated voltage being a voltage wherein a first intercept is subtracted from said first potential difference, wherein said first intercept corresponds to said first potential difference when said current is zero; and said second processing means estimates a second dynamic flame impedance defined as a ratio of a second compensated voltage to said current, said second compensated voltage being a voltage wherein a second intercept is subtracted from said second potential difference, wherein said second intercept corresponds to said second potential difference when said current is zero.

22. An appartus for flame detection in accordance with claim 18, wherein said first processing means estimates a first flame impedance defined as a ratio of said first potential difference to said current; and said second processing means estimates a second flame impedence defined as a ratio of said second potential difference to said current.

23. An apparatus for flame detection in accordance with claim 22 wherein said first processing means estimates a first flame impedance defined as a ratio of said first potential reference to said current and said second processing means estimates a second flame impedance defined as a ratio of said second potential difference to said current.

24. An apparatus for flame detection in accordance with claim 22, wherein said first processing means estimates a first dynamic flame impedance defined as a ratio of a first compensated voltage to said current, said first compensated voltage being a voltage wherein a first intercept is subtracted from said first potential difference, wherein said first intercept corresponds to said first potential difference when said current is zero; and said second processing means estimates a second dynamic flame impedance defined as a ratio of a second compensated voltage to said current, said second compensated voltage being a voltage wherein a second intercept is subtracted from said second potential difference, wherein said second intercept corresponds to said second potential difference when said current is zero.

25. An apparatus for flame detection in accordance with claim 18, wherein said first processing means estimates a first dynamic flame impedance defined as a ratio of a first compensated voltage to said current, said first compensated voltage being a voltage wherein a first intercept is subtracted from said first potential difference, wherein said first intercept corresponds to said first potential difference when said current is zero; and said second processing means estimates a second dynamic flame impedance defined as a ratio of a second compensated voltage to said current, said second compensated voltage being a voltage wherein a second intercept is subtracted from said second potential difference, wherein said second intercept corresponds to said second potential difference when said current is zero.

26. An apparatus for flame detection in accordance with claim 18, wherein a first resistor is coupled between said pair of reference electrodes and a second resistor is coupled between one electrode of said pair of reference electrodes and said burner, the potential of said one electrode being lower than the potential of said second electrode.

27. An apparatus for flame detection in accordance with claim 18, wherein said flame rod and said pair of reference electrodes are oriented in a longitudinal direction with respect to said burner.

28. An apparatus for flame detection in accordance with claim 18, wherein said burner further comprises a plurality of burner ports; and an end of said flame rod and an end of each of said pair of reference electrodes are arranged above at least one of said plurality of burner ports.

29. An apparatus for detecting a flame for use with a conductive burner having a burner port, said conductive burner producing said flame having charged particles, said apparatus comprising:

a flame rod placed in contact with said charged particles, wherein a power source is electrically coupled between said flame rod and said conductive burner for supplying a voltage thereto;

current detecting means coupled between said flame rod and said conductive burner for detecting a current;

reference electrodes placed in contact with said charged particles in said flame, a first reference electrode in contact with a first equi-potential plane, and a second reference electrode in contact with a second equi-potential plane, said first and second equi-potential planes formed between said flame rod and said burner when said voltage is applied thereto;

first potential difference detecting means for detecting a potential difference between said first reference electrode and said second reference electrode;

first processing means for estimating a first flame impedance based on said first potential difference and said current;

second potential difference detecting means for detecting a second potential difference between said first electrode and said flame rod, the potential of said first electrode being higher than the potential of the second electrode; and second processing means for estimating a second flame impedance based on said second potential difference and said current.

30. An apparatus for flame detection in accordance with claim 29, wherein said first processing means estimates a first flame impedance defined as a ratio of said first potential difference to said current; and said second processing means estimates a second flame impedance defined as a ratio of said second potential difference to said current.

31. An apparatus for flame detection in accordance with claim 30, wherein said first processing means estimates a first dynamic flame impedance defined as a ratio of a first compensated voltage to said current, said first compensated voltage being a voltage wherein a first intercept is subtracted from said first potential difference, wherein said first intercept is said first potential difference corresponding to said current being zero; and said second processing means estimates a second dynamic flame impedance defined as a ratio of a second compensated voltage to said current, said second compensated voltage being a voltage wherein a second intercept is subtracted from said second potential difference, wherein said second intercept is said second potential difference when said current is zero.

32. An apparatus for flame detection in accordance with claim 30, wherein a first resistor is coupled between said pair of reference electrodes and a second resistor is coupled between one electrode of said pair of reference electrodes and said burner, the potential of said one electrode being lower than the potential of said second electrode.

33. An apparatus for flame detection in accordance with claim 30, wherein said flame rod and said pair of reference electrodes are oriented in a longitudinal direction with respect to said burner.

34. An apparatus for flame detection in accordance with claim 30, wherein said burner further comprises a plurality of burner ports; and an end of said flame rod and an end of each of said pair of reference electrodes are arranged above at least one of said plurality of burner ports.

* * * * *

UNITED STATES PATENT AND TRADE MARK OFFICE

CERTIFICATE OF CORRECTION

PATENT NO. : 5,952,930
DATED : September 14, 1999
INVENTOR(S) : Umeda et al.

It is certified that error appears in the above-identified patent and that said Letters Patent is hereby corrected as shown below:

Column 15, line 54, after "input" insert --fuel-- in both occurrences.

Column 15, line 64, delete "19" insert --18--.

Signed and Sealed this

Thirty-first Day of October, 2000

*Attest:*

Q. TODD DICKINSON

*Attesting Officer*

*Director of Patents and Trademarks*